US006255787B1

(12) United States Patent
Belleveau

(10) Patent No.: US 6,255,787 B1
(45) Date of Patent: Jul. 3, 2001

(54) AUTOMATED LIGHTING CONTROL SYSTEM UTILIZING LASER AND NON-LASER LIGHT SOURCES

(75) Inventor: Richard S. Belleveau, Austin, TX (US)

(73) Assignee: High End Systems, Inc., Austin, TX (US)

( * ) Notice: Subject to any disclaimer, the term of this patent is extended or adjusted under 35 U.S.C. 154(b) by 0 days.

(21) Appl. No.: 08/956,660

(22) Filed: Oct. 23, 1997

(51) Int. Cl.[7] ..... H05B 37/00

(52) U.S. Cl. ..... 315/312; 315/149; 315/363; 250/205

(58) Field of Search ..... 315/241 P, 149, 315/152, 155, 156, 157, 158, 159, 363, 76, 312; 250/205

(56) References Cited

U.S. PATENT DOCUMENTS 5,498,935 * 3/1996 McMahan et al. ..... 315/241 P

* cited by examiner

*Primary Examiner*—David Vu

(57) ABSTRACT

An energy emission system is provided having both multiple laser outputs and multiple light or lamp outputs. The laser outputs may be aligned so that once they are active, they are directed to strike targets located distal from the lamps and lasers. By configuring the lasers at known positions relative to the lights, the lights can subsequently be activated so that their outputs are aligned with the laser beams. The laser beams therefore serve to aim the lights and specifically, the light outputs upon an isolated target area. Using the lasers to align the lights avoids having to activate the lights to effectuate their alignment, resulting in increased light longevity and providing more accurate alignments in lighted ambient conditions. A controller can be used to control multiple lasers and lights. Data from the lasers can be used to control colors, shapes, and positions of lights using a memory coupled to the controller.

9 Claims, 5 Drawing Sheets

AUTOMATED LIGHTING CONTROL SYSTEM UTILIZING LASER AND NON-LASER LIGHT SOURCES

BACKGROUND OF THE INVENTION

1. Field of the Invention

This invention generally relates to a system with moveable light sources and, more particularly, to a system for controlling the moveable light sources during use.

2. Description of Related Art

There are many types of lights. A popular high intensity light includes a discharge lamp. A lamp typically comprises a quartz tube filled with gas. The gas ambient is exposed to a pair of electrodes. During times when current is passed between the electrode pair, the gas is excited to a plasma state which causes photon emissions. Plasma excitation results in high intensity light emission from the lamp.

U.S. Pat. No. 5,128,596 to Shimazu et al. relates to a gaseous-discharge lamp having a reflector in the interior thereof U.S. Pat. No. 4,339,789 to Husby et al. relates to a flood light aiming method using a laser. Both of these patents are hereby incorporated by reference.

In many applications, lamp discharge must be moved in order to illuminate a target area on or near a display surface. For example, the display surface may include a stage containing one or more performers. To draw attention to the performers, it is desirable to forward the lamp output on only the target area containing one or more performers.

A luminaire can be used to move the lamp output and the characteristics of that output. For example, a luminaire may include a yoke, means for movably suspending the yoke from a support, and a housing movably connected to the yoke. A lamp may be secured within the housing, also containing possibly a light dispersion lens. Still further, the housing may include color filters and/or a disc of cast material. A pattern may be formed upon the material to allow the lamp output to change not only in color, but to project a pattern upon the target area.

The lamp-containing luminaire is moveably mounted proximate to the display surface. The luminaire periodically controls lamp output to illuminate an isolated target area within the display surface. For example, lamp output is desirably programmed to activate and deactivate at certain times so that a target area in which a performer stands is periodically illuminated. Thus, once the moving mechanism of the luminaire establishes the point in which lamp output impinges the target area, it may remain in that position, for example, throughout a stage performance.

Aiming the lamp output upon the target area to establish the initial position is, unfortunately, sometimes difficult. Typically, the lamp is aimed prior to the performance when ambient light conditions are not condusive for detecting light output. For example, most performances in which a lamp is used occur when the ambient light is substantially reduced if not eliminated. This allows the lamp output to readily discern and focus upon the performer placed in the target area. Unfortunately, the lamp is aimed to that target area prior to performance, and prior to the darkening of the ambient light. When light exists in the room, or daylight illuminates the display surface, operators cannot easily determine where the lamp output illuminates the display surface, especially if the display surface is a significant distance from the lamp. An operator may therefore be required to maintain the lamp active during set up for a substantially long period of time in order to properly aim the lamp. Moving the lamp about the yoke and/or support may require additional time, all of which adds to the duration in which the lamp must be active throughout the aiming procedure.

Light output involving lamps of the "discharge" variety mandate that the lamp output be extremely intense. To illuminate a target area that is a significant distance from the lamp requires a very high energy output. To maintain this high output, substantial heat oftentimes exceeding 1000° F. will develop within the lamp components during a normal activation sequence. Over time, the heat will degrade those components, and eventually, cause the lamp to fail.

It would therefore be desirable to have a moveable light fixture containing a light source. An improvement to the light fixture, and embodied light source, involves accurate aiming of that source. A light fixture aiming device and/or light source aiming device is thereby needed which does not require activation of the light. More specifically, an improved mechanism and method is needed for accurately aiming what will be the light output without actually having to turn on the light. Further, the improved mechanism is one that can be used regardless of ambient light conditions.

In addition, it is desirable to be able to control multiple lights. Specifically, during an event such as a music performance, it is desirable to be able to control the color, shape, and position of multiple lights. Such controls are somewhat difficult to implement in many events since operators typically are not afforded much time to input control data. Thus an improved system and method is needed for allowing multiple lights to be controlled.

SUMMARY OF THE INVENTION

The problems outlines above may in large part be solved by a system and method hereof The system typically includes a laser mounted proximate to a light, or a fixture which houses a light (e.g., luminaire). According to one embodiment, the laser can be mounted to the luminaire housing which surrounds the light such that when the lamp-containing luminaire moves so must the laser. The light includes any device that generates coherent electromagnetic radiation within the visible part of the spectrum. Coherent light is characterized by a narrow beam less than, for example, 3.0 cm in cross-sectional diameter. Lasers suitable for the present application can be classified from various categories, including chemical, gas, liquid, metal vapor, semiconductor and/or solid state.

According to a preferred embodiment, a laser beam output from the laser is directed along a beam axis which is fixed in relation to a central axis along which output from the light can be configured to extend. As defined hereinbelow, the terms "lamp" and "light" are interchangeable, and each are housed within a fixture—sometimes referred to as a luminaire. The light is moveable with the fixture which embodies the light. The laser is preferably attached to the light fixture, thus serving to aim the fixture and the light fixed inside the fixture. Once the fixture is fixed in an aimed position, light output emanating from the fixture will preferably be fixed upon the targeted display area.

The laser beam is preferably, but not always, activated before the light is activated. Laser beam impingement upon the display surface indicates a target area which the light output will illuminate when active. Accordingly, a central axis along which the light extends is typically fixed in relation to the laser beam, or axis drawn by the laser beam. The central axis is preferably a line about which the output from the lamp extends. The beam axis can either be collinear with the central axis, or parallel to and spaced from the central axis. The light output is, in some circumstances, inactive until after the laser beam is terminated. Accordingly, the laser beam may, in some circumstances, be used to aim the light so that when the light output is active, the light output will illuminate the "aimed" area. If the light and the laser are both active, the point in which the laser beam and light output strike the display area is generally fixed relative to one another.

In an alternate embodiment the laser may be mounted proximate to the light in a luminaire that does not direct the light by moving the luminaire. Instead, the light is directed with a moving mirror. In this embodiment the laser beam may be directed by the same mirror that directs the light beam.

According to another embodiment, multiple lasers and respective multiple lights may be interconnected, and controlled from, e.g., a singular controller or control unit. The controller may transmit packets of data across a serial link connecting the control unit to lights and lasers. For example, digital signals (e.g., bits) within the packetized data can selectively activate and deactivate lights within the serial-linked multiple lights, or activate and deactivate lasers separate from respective lights. Accordingly, times when the lights and lasers situated about a display surface are active can be programmed, and the respective laser used to aim each particular light can also be programmed separate from the other lights. Light colors, shapes, and positions may all be controlled using data from the lasers. Such controls may be implemented to create an event program that allows multiple sets of light data to be sequentially used during a show to create multiple light conditions.

According to yet a further embodiment, a method is contemplated for controlling multiple lights. The method includes providing lasers secured to the lights. Laser beam outputs are then typically directed from the lights to a target position upon a display surface such that the lasers, and lights fixed in relation to the lasers, are placed in an aimed position. Thereafter the lights are preferably activated. Once activated, the light outputs coincide a pre-existing distance from or directly upon the point in which the laser beams impinge the target position. Automatic controls are preferably used to control multiple lasers and multiple lights in multiple pre-programmed light conditions.

BRIEF DESCRIPTION OF THE DRAWINGS

Other objects and advantages of the invention will become apparent upon reading the following detailed description and upon reference to the accompanying drawings in which.

DETAILED DESCRIPTION OF PREFERRED EMBODIMENTS

Figure 1:
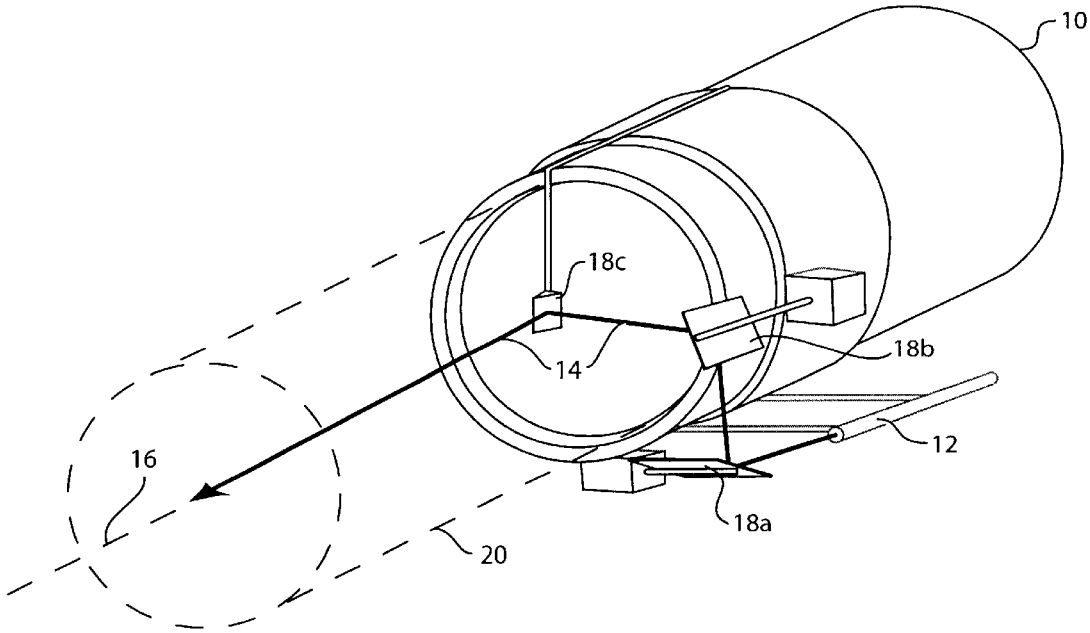
FIG. 1 is a plan perspective view of a system for producing and directing output from a laser and a light along a central axis.

Turning now to the drawings, FIG. 1 illustrates a lens tube 10 which is typically at least particularly enclosed in a light fixture housing (not shown) with various optical components such as, for example, a lens, a selectively transparent element, moveable color mechanisms (e.g., light filters, prisms, etc.), movable shape mechanisms (e.g., shape filters, prisms, etc.), and/or heat dissipation mechanisms. Coupled to the shroud which surrounds tube 10 may be a laser 12, according to one embodiment. Laser 12 is arranged to produce a laser beam 14. Beam 14 can be manipulated or directed, such that it is eventually fixed in position along a central axis 16.

Central axis 16 is defined as a line extending from lens tube 10 around which light output may extend, according to one embodiment, in a substantially circular fashion. Accordingly, a cross-section of the light output would typically present a circle having central axis 16 extending through the center of that circle. Various positioning devices 18*a*, 18*b* and 18*c* which may be driven by galvanometers or a similar device are used to align laser beam 14 along central axis 16. Positioning devices 18*a*, 18*b* and 18*c* preferably include mirrors which reflect beam 14 such that it remains at a fixed position along central axis 16. The positioning devices can be placed in the optical path, removed from any focal plane. Otherwise the shape of the position device would be projected. As will be described herein below, laser beam 14 occurs preferably before a light produces output 20.

Figure 2:
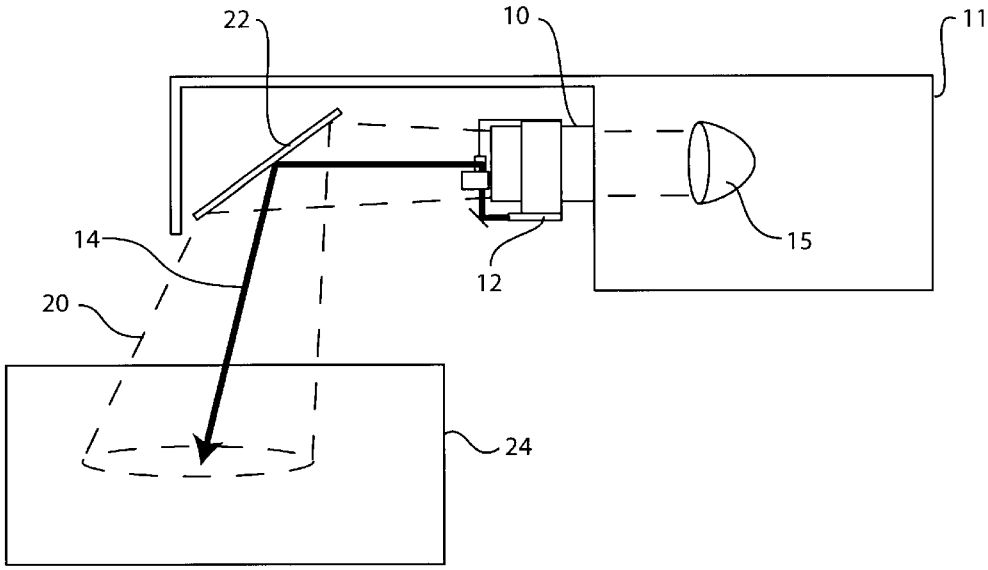
FIG. 2 is a plan side view of the mechanism of FIG. 1 having a mirror placed in the laser and light output paths to further direct those outputs upon a display surface.

FIG. 2 indicates the aiming mechanism of FIG. 1, shown as a side elevational view. Specifically, lens tube 10 is shown through which output 20 is sent from a lamp 15 (or light source) fixedly housed within light fixture 11. In addition, FIG. 2 indicates an additional positioning device 22. Positioning device 22, typically a mirror, allows laser beam 14 to strike a display area 24 which is aligned such that it will not receive the laser beam unless the beam is reflected from mirror 22. Accordingly, mirror 22 allows remote pointing of remote laser beam 14 upon a surface which is not within the line of sight of the originally emanating beam. Once positioned, device 22 remains in that position to allow similar reflection of light output 20. Positioning of device 22 therefore allows an additional dimension by which the laser beam and light output can be positioned.

Figure 3:
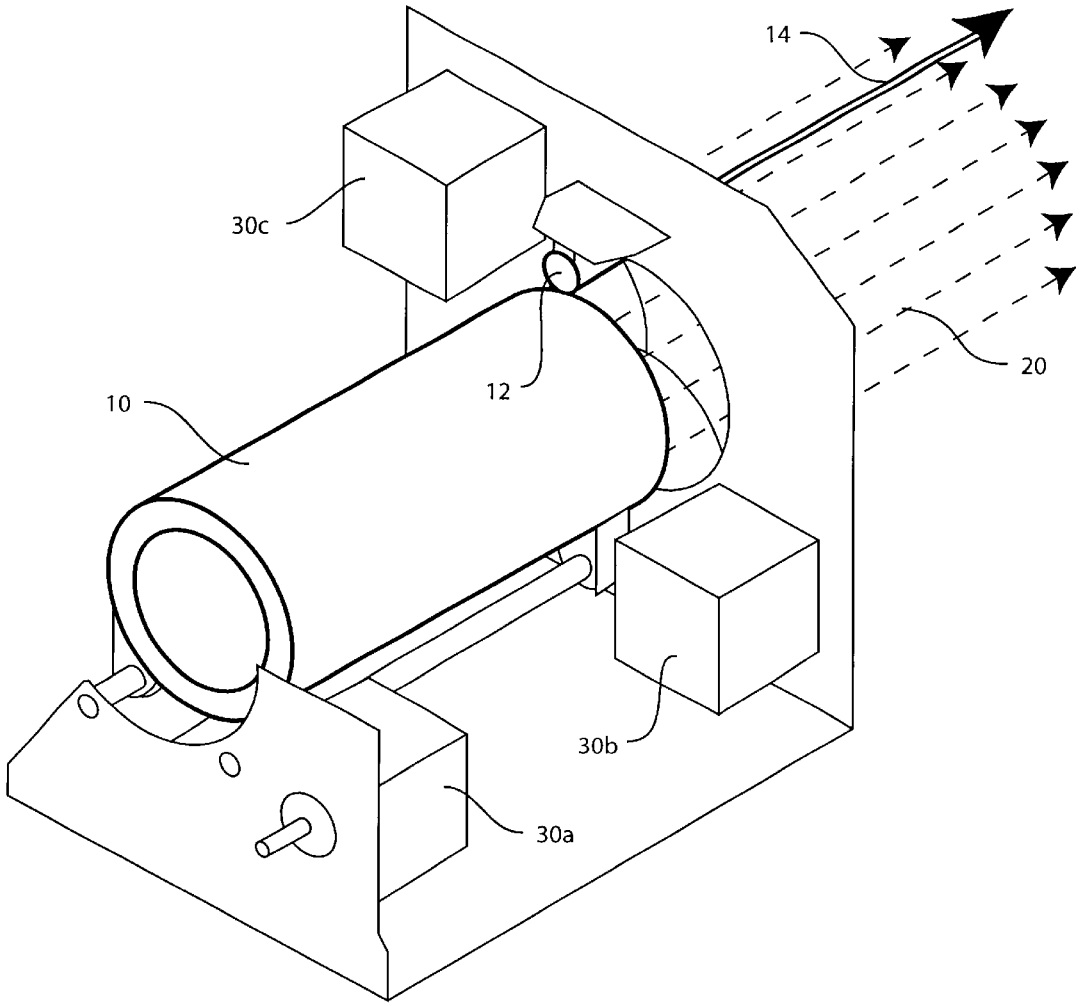
FIG. 3 is a perspective view of a mechanism for producing laser output a fixed distance from and parallel to the central axis of the light output.

FIG. 3 illustrates in more detail the various mechanisms associated with lamp output 20, and used to produce the colors and/or shapes (e.g., patterns) associated with lamp output 20. For example, lens tube 10 can be moved along the optical path by one or more stepper motors 30. Various color mechanisms and shape mechanisms such as filters, flags, gobo patterns, optical dimmers, and dispersion mechanisms (frost lenses, prisms, etc.) can be positioned into and out of the optical path. Typically the light fixtures for which the present invention are useful can be remotely controlled. Laser 12 is coupled to the housing of lens tube 10 and/or to the housing of the fixed elements (i.e., fixture) which house or surround the lamp source. Laser 12 is generally spaced a fixed, radial distance from the central axis of the optical path emanating from the light. During operation, laser 12 produces laser beam 14. As shown in FIG. 3, laser beam 14 is spaced a fixed radial distance from the lens tube 10 output 20. Accordingly, FIG. 3 illustrates an embodiment dissimilar from that shown in FIGS. 1 and 2. In FIG. 3 laser beam 14 can be spaced a fixed distance from and parallel to a central axis or, in the alternative, be placed collinear with the central axis.

Figure 4:
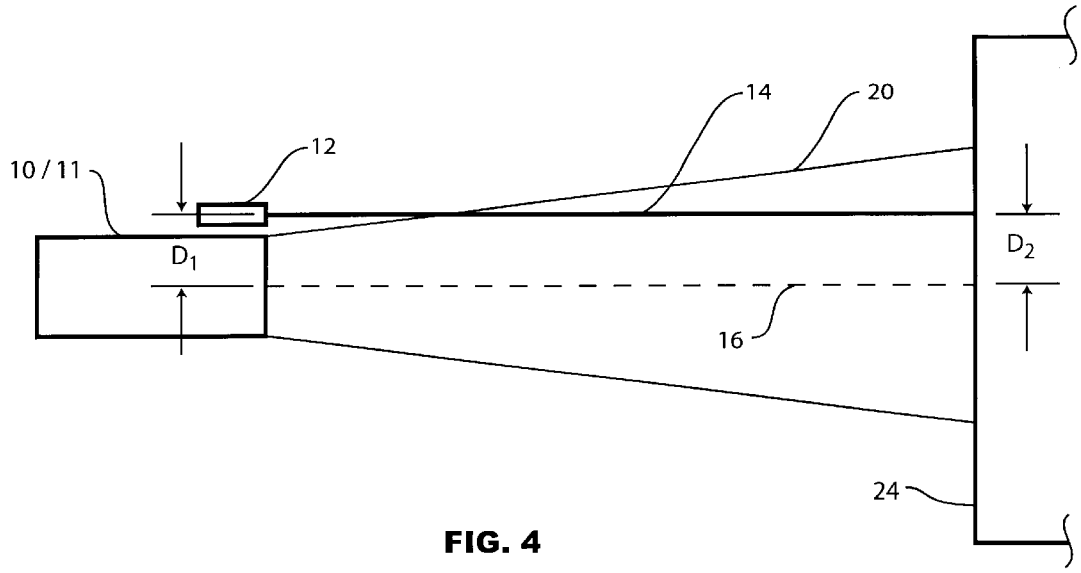
FIG. 4 is a plan view of the mechanism of FIG. 3, wherein the distance in which the laser is mounted from the light is maintained upon the display surface.
Figure 5:
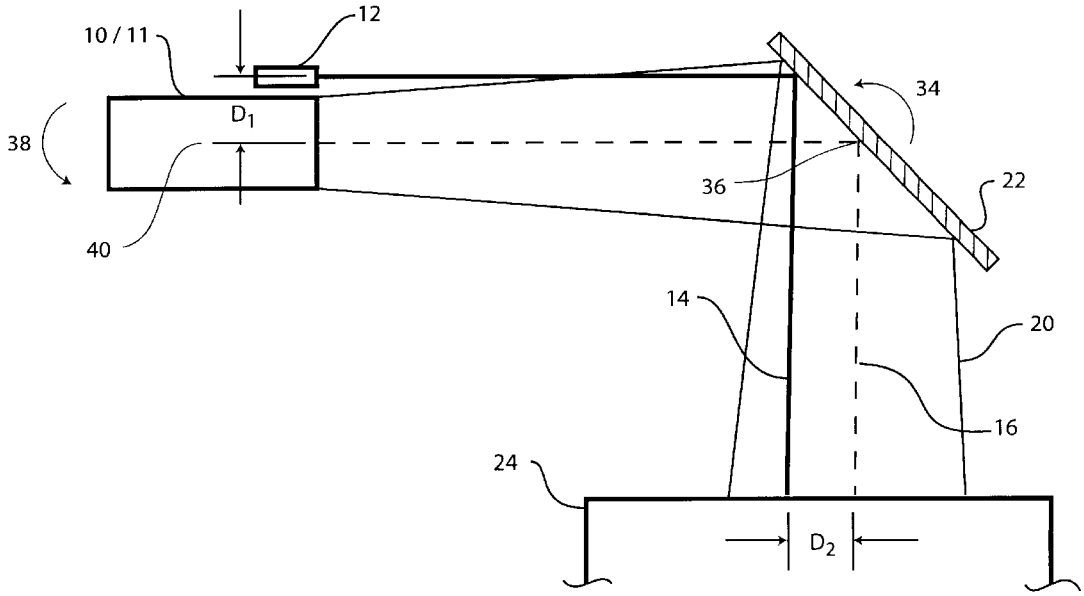
FIG. 5 is a plan view of the mechanism of FIG. 3 mounted upon a moveable holder, wherein the output from the laser and light may be reflected from a moveable mirror.
Figure 6:
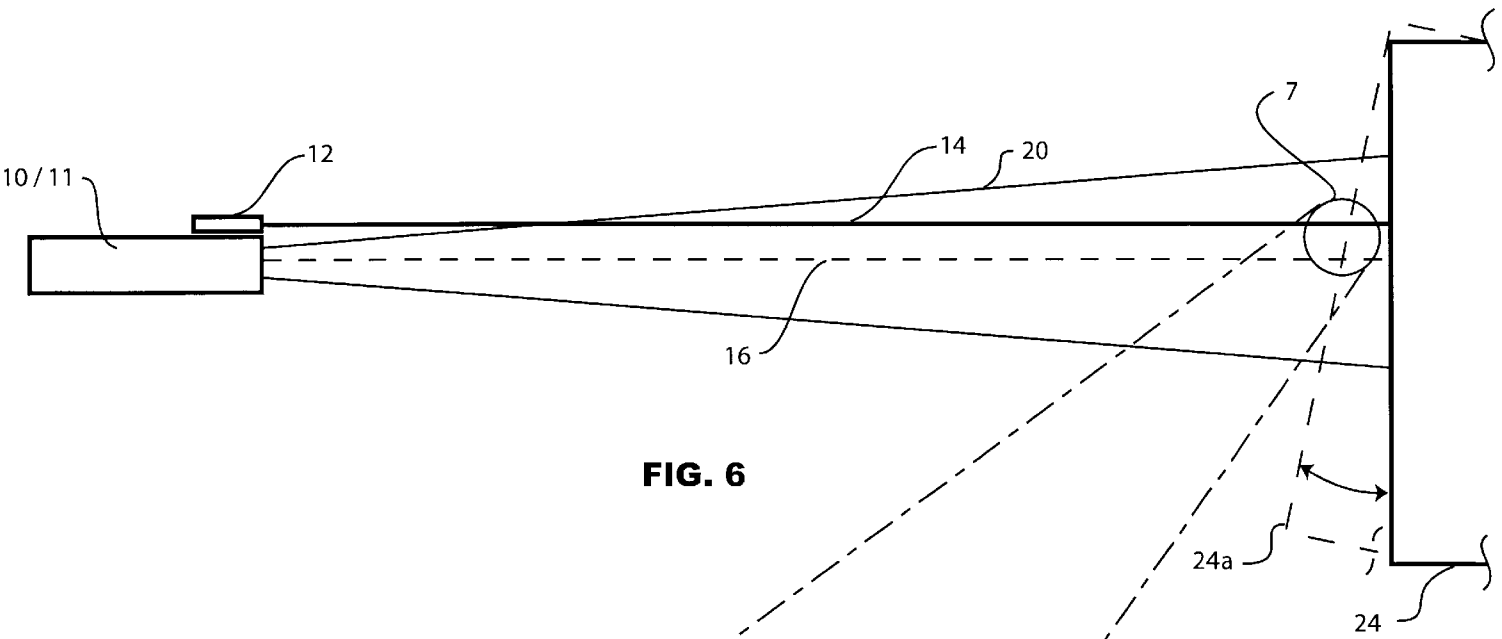
FIG. 6 is a plan view of the mechanism of FIG. 4, wherein the length of output and the amount of output dispersion is shown relatively large compared to the offset distance between the laser beam and the central axis of the light output regardless of changes in orientation between the light output and the display surface.

FIGS. 4, 5 and 6 illustrate in more detail the effect of placing laser beam 14 a spaced distance from the central axis. As shown in FIG. 4, a distance $D_1$ at which laser 12 is mounted above the center region of lamp output 20 is maintained to the display surface 24 remotely situated from fixture 11 and/or lens 10. Accordingly, whatever spacing exists between laser 12 and the fixture to which it is mounted (i.e., the light fixture 11 or the lens 10), that spacing is registered upon the display surface so that an operator will know approximately where a light output 20 will reside relative to the point at which beam 14 strikes display surface 24. Thus, a display surface 24 placed somewhat perpendicular to beam 14 output will indicate a distance $D_2$ approximately equal to distance $D_1$.

FIG. 5 illustrates a further embodiment by which remote positioning device 22 is included. Positioning device 22 preferably includes a mirrored surface configured to receive light output 20 and laser beam 14, and to reflect light energy thereof upon display surface 24 arranged in a plane outside the view angle of the originally emanated output. Positioning device 22 can be rotated 34 about axis 36. Likewise, fixture 11 and laser 12 can be rotated 38 about axis 40. Rotation of the fixture (i.e., lens 10 or fixture 11) which secures a lamp source and laser 12 in coordination with rotation of positioning device 22 allows the various light energies derived from position device 22 to strike surface 24 at substantially perpendicular angles as shown. This allows distance $D_2$ to approximate distance $D_1$.

FIG. 6 illustrates a substantially long optical path of beam 14 and lamp output 20. Output 20 disperses from fixture 11 or lens 10 at a relatively constant angle until it strikes surface 24. The amount of dispersion is significant relative to the distance between central axis 16 and laser beam 14. It is believed that an optical distance which is relatively large may significantly disperse the lamp output (e.g., by several feet) from the central axis. Thus, when aiming is effectuated with the laser beam, the position of lamp output 20 upon surface 24 relative to laser beam impingement is somewhat minor. Therefore, an operator who directs a laser beam upon a distally located surface can be assured that even though the laser beam is offset a fixed distance from the central axis, the ensuing central point of the lamp output will be a known, relatively small, distance from the point of laser beam impingement. Even if the display surface is angled, such as shown by reference numeral 24*a*, the small variation and distance caused by that angle is relatively small.

Figure 7:
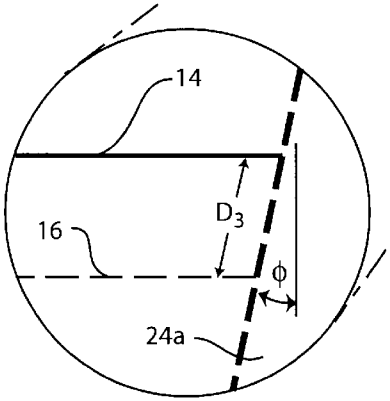
FIG. 7 is a detailed view along area 7 of FIG. 6.

FIG. 7 illustrates in detail the geometric relationship between a distance registered upon a non-tilted surface and a distance $D_3$ registered on a tilted surface. The amount of tilt Ø will dictate this geometric relationship. Knowing the amount of tilt relative to laser 12 and light or lamp fixture 11 will allow one to determine the relative placement between beam 14 and central axis 16. Accordingly, a program can be written to determine the tilt angle and, from the tilt angle, to determine the change in spacing between central axis 16 and beam 14 at the point at which they impinge the tilted surface. A mirror, for example, can be placed upon the tilted surface such that when beam 14 strikes the mirror, the angle of reflection can be recorded upon a photodetector. The tilt angle is deemed proportional to the angle of reflection which, when known, allows an operator to compensate for by moving the laser beam point of incidence to account for the tilt.

Figure 8:
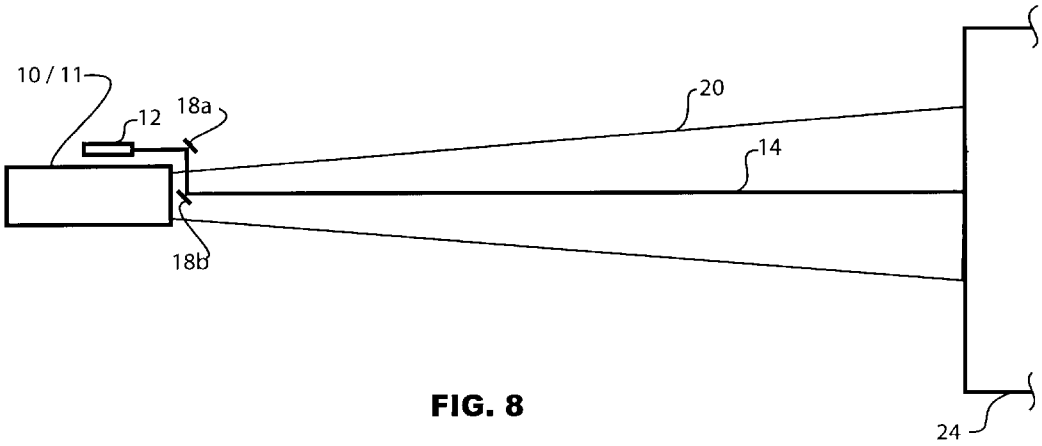
FIG. 8 is a plan view of the mechanism of FIG. 3, wherein the laser output can be directed through mirrors to the central axis of the lamp.

FIG. 8 illustrates another embodiment in which positioning device includes two devices 18*a* and 18*b*. Positioning devices 18*a* and 18*b* are preferably fixed at their angular position relative to beam 14 striking the first of two positioning devices. Positioning devices 18*a* and 18*b* preferably place laser beam 14 along the central axis concentrically within the radial dispersion of lamp output 20.

Figure 9:
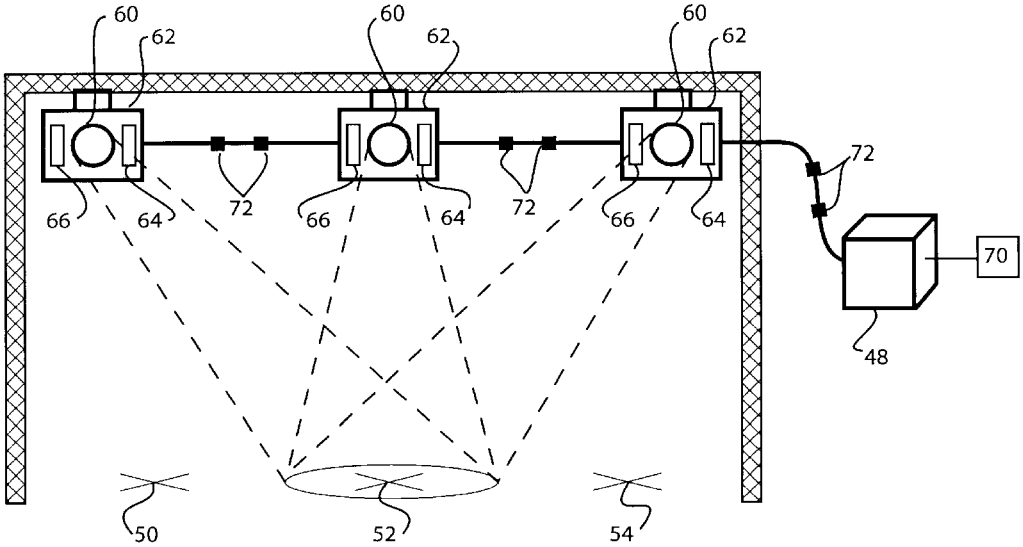
FIG. 9 is a plan view of a system including multiple lights operable from a controller.

FIG. 9 illustrates a plurality of lights 60 equipped with laser point devices previously described, each of which is mounted to a truss 46 proximate to a stage area, or display. Each light can be linked to receive control signals from a controller or control unit 48. Controller 48 may include or be connected to a memory 70. Controller 48 preferably contains discrete circuits or integrated circuits used in producing, sending and/or receiving a stream of data (such data is schematically represented by item 72). Such data 72 is typically sent to and received from the lights 60, lasers 12, the color mechanisms 64, and/or the shape mechanisms 66. Typically such data 72 is in the form of digital values.

Stored within memory 70 may be data known as "pre-set focus points" or "light conditions". The pre-set focus points or light conditions are data concerning light color, shape, and/or position to which lamp output 20 is directed periodically throughout an event. Such light conditions may be entered either through operator input or by a show program stored in memory 70. Memory 70 may be in the fixtures 11, and/or in repeaters (not shown) or peripheral equipment and storage media such as CD-ROMs and discs (not shown).

Shown in FIG. 9 are three exemplary pre-set focus points 50, 52 and 54. Prior to the performance, each light output 20 may be programmed to each point 50, 52 and 54. Color, shape, and/or positional data for each fixture 62, for each color mechanism (shown schematically as item 64), and for each shape mechanism (shown schematically as item 66) may be stored in memory 70. Such data may be used by controller 48 to set light conditions for various lights 60 during the performance. For example, a subset of light fixtures 62 may direct a subset of lights 60 to point 52 at during a particular moment within the performance, with color mechanisms 64 causing the light from different lights to be different colors, and shape mechanisms 66 causing the light from different lights to be in different forms, patterns, or shapes. Later the same or a different subset of lights, and/or light conditions, may be directed to another point or possibly multiple pre-set points to present a different "look" to the audience attending the performance.

The use of pre-set points is augmented by the rapidity by which output 20 can be directed to those points prior to the performance according to a laser aiming mechanism described herein. The laser beam is thereby used to identify desired pre-set points 50, 52 and 54 so that data as to those points can be rapidly compiled and stored in memory 48 and later used by controller 48. The data is then periodically called upon during the performance to rapidly direct output 20 in a desired pattern from point-to-point across the display area or stage.

The rapidity and accuracy with which the light conditions can be stored provides an advantage in the loading time for a performance that is on tour moving from one venue to another. Usually, it is desirable to reuse the show program in each venue. However, since the venue sizes, shapes and configurations will vary, the show program will not create the equivalent "looks" in a new venue. By referencing the show program to, e.g., a lookup table in memory 70 that includes color, shape, and/or position data for each light at each time period in the performance, the program can be reused by merely reprogramming the lookup table data (e.g., by reloading a new set of positional data points into memory 48), rather than reprogramming the entire performance program. In addition, if lasers are used as described herein, the lookup table data may be updated, revised, and/or created without using the lights at all, and without using artificial "smoke" in conjunction with the lights. Thus a preprogrammed performance may be updated for a new location even when the performance area is being used for other purposes (e.g., for setting up musical equipment, props, etc.).

In an embodiment it is believed that having one controller 48 for both the lasers and the lights (including light color mechanisms, light shape mechanisms, and/or light positional mechanisms) is advantageous in that the operator is not required to use two different controllers to program and operate during a performance. In addition, the lasers may, in certain circumstances, be on at the same time as the lights. Such lasers may be a feature of the light display, so it is desirable that the operator be able to control the lasers at the same time, and/or in conjunction with, the lights themselves.

It will be appreciated to those skilled in the art having the benefit of this disclosure that this invention is believed applicable to any energy emission systems involving, for example, light energy. Furthermore, it also to be understood that the form of the invention shown and described is to be taken as exemplary, presently preferred embodiments. Various modifications may be made to each and every components provided, however, the lamp is accurately aimed preferably before activating the lamp. It is therefore intended that the following claims be interpreted to embrace all such modifications and changes and, accordingly, the specification and drawings are to be regarded in an illustrative rather than a restrictive sense.

What is claimed is:

1. A system for controlling a plurality of lights, comprising:

a first laser mounted in fixed relation to a first light for producing a first laser beam during use that is directed along a first beam axis which is fixed in relation to a first central axis along which output from the first light operably extends during use;

a second laser mounted in fixed relation to a second light for producing a second laser beam during use that is directed along a second beam axis which is fixed in relation to a second central axis along which output from the second light operably extends during use; and a controller coupled to the first laser, the second laser, the first light, and the second light, and wherein the controller is coupled to a memory that is adapted to include first light data for the first light and second light data for the second light, and wherein the controller uses the first light data to control the first light and the second light data to control the second light during use.

2. The system of claim 1 wherein the controller receives data from the first laser to create the first light data during use, and the controller receives data from the second laser to create the second light data during use.

3. The system of claim 1 wherein the controller sends data to the first light to position the first light during use, and wherein the controller sends data to the second light to position the second light during use.

4. The system of claim 1 wherein the controller receives data from the first laser to create the first light data during use, and the controller uses the first light data to position the first light during use, and wherein the controller receives data from the second laser to create the second light data during use, and the controller uses the second light data to position the second light during use.

5. The system of claim 1, further comprising color mechanisms coupled to color the first light, and wherein the controller uses the first light data to control the color mechanisms.

6. The system of claim 1, further comprising shape mechanisms coupled to apply a shape the first light, and wherein the controller uses the first light data to control the shape mechanisms.

7. The system of claim 1, further comprising color mechanisms coupled to color the first light, and shape mechanisms coupled to shape the first light, and wherein the controller uses the first light data to control the color mechanisms, to control the shape mechanisms, and to control the position of the first light during use.

8. The system of claim 1, further comprising a mirror interposed between the first light and a first light display surface and between the second laser and a second light display surface.

9. The system of claim 1 wherein the first beam axis is parallel to and spaced from the first central axis.

* * * * *